United States Patent [19]

Manderscheid

[11] 4,059,150

[45] Nov. 22, 1977

[54] ANCHORING ASSEMBLY

[75] Inventor: Phillip H. Manderscheid, Cypress, Tex.

[73] Assignee: Brown Oil Tools, Inc., Houston, Tex.

[21] Appl. No.: 656,093

[22] Filed: Feb. 9, 1976

[51] Int. Cl.[2] ..... E21B 33/129

[52] U.S. Cl. ..... 166/120; 166/123; 166/212; 166/216; 166/217

[58] Field of Search ..... 166/120, 123, 212, 216, 166/217

[56] References Cited

U.S. PATENT DOCUMENTS

| | | | |
|---|---|---|---|
| 3,011,558 | 12/1961 | Conrad | 166/212 |
| 3,024,843 | 3/1962 | Hawes | 166/120 X |
| 3,180,419 | 4/1965 | Cochran | 166/120 |
| 3,211,227 | 10/1965 | Mott | 166/120 |
| 3,623,551 | 11/1971 | Randermann, Jr. | 166/217 |
| 3,722,588 | 3/1973 | Tamplen | 166/123 |
| 3,746,093 | 7/1973 | Mullins | 166/217 |

*Primary Examiner*—Ernest R. Purser
*Assistant Examiner*—William F. Pate, III
*Attorney, Agent, or Firm*—Carlos A. Torres; E. Richard Zamecki

[57] ABSTRACT

Disclosed is an anchoring assembly for anchoring well equipment within a surrounding well conduit. In one form of the invention, the anchoring assembly is specifically described for use as an hydraulically set, retrievable liner hanger. A modified form of the invention describes the anchoring assembly employed with a seal to function as an hydraulically set, retrievable well packer.

34 Claims, 14 Drawing Figures

ANCHORING ASSEMBLY

BACKGROUND OF THE INVENTION

During the completion of oil and gas wells, it is frequently necessary to anchor well equipment, typically a production tubing or well packer, within a well conduit such as a well casing or liner. A large number of anchoring devices have been developed and are employed for this purpose. Usually, the anchoring means employed to anchor the well equipment in place is lowered down through a well conduit to the desired subsurface location and then suitably manipulated or actuated from the surface to cause gripping means, or "slips", and sometimes sealing means, to move radially into engagement with the surrounding well conduit. This operation, referred to usually as "setting" the equipment may be accomplished by physical movement of the tubing string from which the equipment is suspended, in which case, the anchoring and/or sealing means of the equipment is "mechanically set". Such anchoring or sealing means may also be radially extended by the application of hydraulic pressure to an expansion chamber contained within the equipment. In the latter case, the anchoring and/or sealing means is considered to be "hydraulically set". Various other means, including electrically operated setting tools and explosive devices have been employed to set anchoring and/or sealing devices at subsurface locations within a well bore.

The anchoring mechanism in a well packer as well as that in a liner hanger and other equipment must frequently support large structural loads. This fact, coupled with the need to remotely operate the anchoring mechanism from the well surface, make it important to employ devices which may be reliably set and which, when set, can remain set even though exposed to substantial weight and pressure induced forces. Retrievably anchored devices must have all of the foregoing characteristics and in addition, be readily released from their set position when their retrieval is desired.

The large forces which are acting upon these anchoring devices have traditionally required the use of relatively large, heavy components and wedge-type locks. Unless sufficiently heavy, the components may be crushed or distorted by the wedge-type lock designs which are commonly employed. The large size of the components has necessarily limited the size of the central flow passage usually provided through the anchoring device. This passage, which is used to flow the oil or gas being produced, is desirably maintained as large as possible to more efficiently flow the subsurface effluent and also to facilitate movement through the conduit of wireline tools and other equipment which is frequently required in either completing or working over the well.

SUMMARY OF THE INVENTION

The anchoring assembly of the present invention employs a simple, efficient locking means which permits the gripping means in the anchoring assembly to be moved into anchoring engagement with a surrounding well conduit and thereafter prevents the gripping means from releasing such anchoring engagement. In the illustrated forms of the invention, special release means are provided so that the gripping means may be released from such gripping engagement by a suitable operator initiated technique.

The locking means portion of the anchoring assembly of the present invention includes two relatively movable components which perform a ratchet-like function permitting longitudinal movement between the two components in one longitudinal direction but preventing the reverse movement. By this means, the relatively movable components of the anchoring assembly are permitted to move in the direction required to extend the gripping and/or sealing means radially outwardly into anchoring engagement with the surrounding well conduit but are prevented from returning to their original position by the operation of the locking means so that the assembly remains anchored.

The desired functions of a locking means in an anchoring assembly are obtained in the device of the present invention using two simple, cooperating components. In one form of the invention, the first component of the locking means is comprised of a tubular body which is free to be moved longitudinally relative to a central mandrel. The second component of the locking means includes a tubular sleeve which is temporarily affixed longitudinally relative to the mandrel and extends about the first locking component. The outer surface of the first locking component is contoured in the form of a series of axially spaced, circumferentially extending shoulders with inclined or tapered surfaces extending between adjacent shoulders so that the cross section through the first member has a saw tooth profile. An oppositelyconfigured contour is provided on the inside surface of collet fingers which are formed on the second locking member. The collet fingers are resiliently secured to the second locking member and are biased radially inwardly so that the two contoured surfaces are in intimate physical contact. The oppositely facing shoulders permit relative movement between the two components in only one longitudinal direction.

The described locking configuration differs from prior art locking means commonly found in the well completion art in that there is no reliance upon wedging to lock the two components together. The elimination of the wedging structure permits the locking portion of the anchoring assembly to be comprised of only three overlapping tubular bodies, specifically the mandrel, and the first and second locking components. As a result, the internal diameter of the flow opening through the mandrel may be substantially greater than is possible when more complicated and larger locking means are employed. The elimination of a wedging-type locking function also reduces the radially inwardly directed forces acting against both the locking means and the mandrel. Accordingly, the structural strength of the mandrel and locking means may be reduced which in turn permits a larger mandrel flow opening.

The simplicity of the locking means contributes to both the reliability of the anchoring assembly and to its low cost of fabrication.

In specific illustrated embodiments of the invention, the gripping means are provided by slips which are extended radially outwardly by the operation of two opposed conical spreaders. During the setting operation, the two spreaders advance longitudinally toward each other causing a radially outward movement of the slips in a conventional manner. The use of the dual opposed cones functions to firmly anchor the assembly against displacement in either longitudinal direction.

Hydraulic setting means are employed to advance the first locking component longitudinally relative to the mandrel assembly and the gripping means. This function, in the preferred form of the device, allows the first locking component to provide the dual purpose of transmitting the setting force from an hydraulic expansion chamber to the gripping means while simultaneously providing the locking action which prevents the anchoring assembly from releasing once it has been set.

The anchoring means of the present invention, when combined with a seal element functions as a well packer. Setting of the packer seal is accomplished by the same hydraulic setting force which sets the gripping means.

Release of the anchoring means from its gripping position, in either the packer or anchor form, may be easily accomplished by provision of suitable release means. One such release means, described hereinafter with respect to the packer assembly, permits the mandrel to be freed from the second locking component by suitable rotational movement of the tubing string from which the well packer is suspended. An alternate release form, described herein for use with the anchor form of the invention, frees the second locking component when the tubing string is pulled upwardly to shear a connecting component.

Other features, objects and advantages of the invention will become more readily apparent from the accompanying drawings, specification and claims.

DESCRIPTION OF THE ILLUSTRATED EMBODIMENTS

Figure 1:
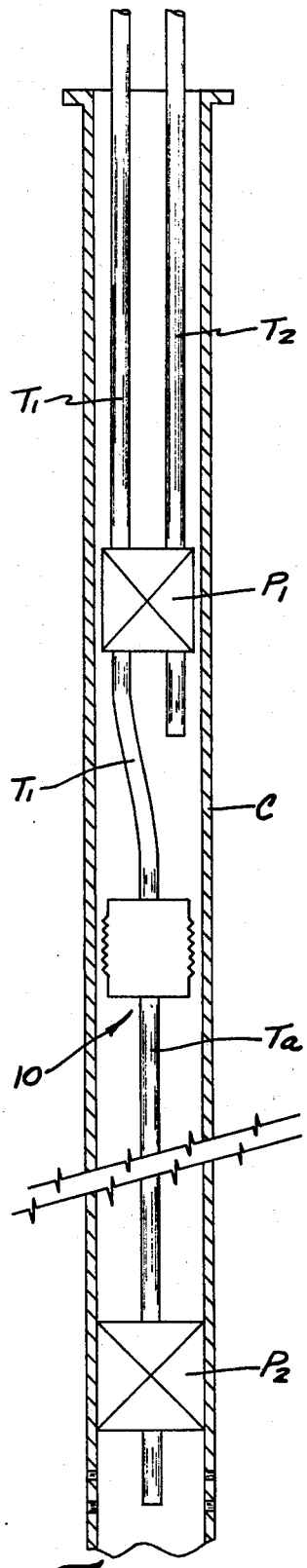
FIG. 1 is an elevation, partially in section, schematically illustrating the anchoring assembly of the present invention employed as a tubing anchor between two well packers.
Figure 2:
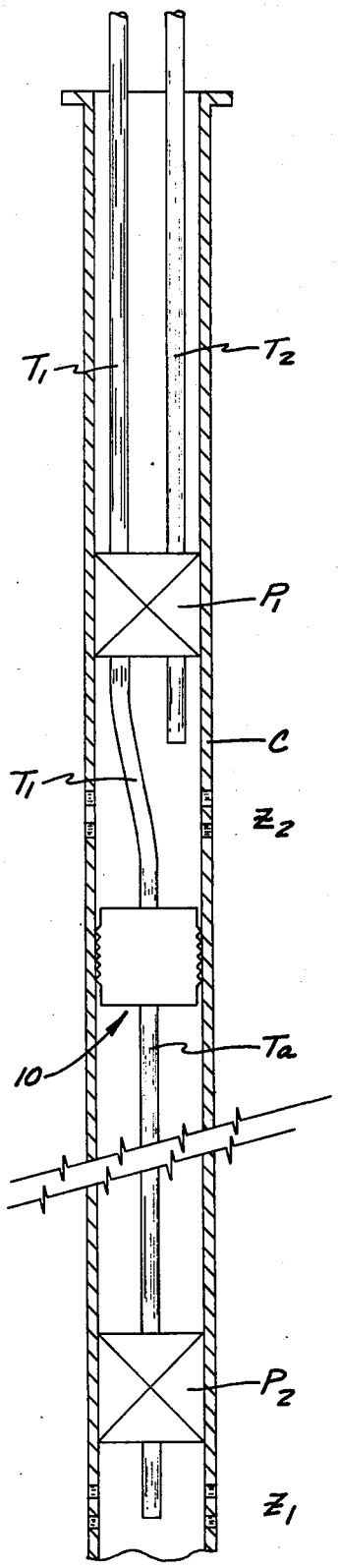
FIG. 2 is a view similar to FIG. 1 illustrating the tubing anchor and well packers set within a surrounding well conduit, ready for production.

The tubing anchor form of the present invention is indicated generally at 10 in FIG. 1. The tubing anchor is employed to suspend a length of tubing $T_a$ within a surrounding well conduit or casing C. FIG. 1 illustrates a dual completion which includes two tubing strings $T_1$ and $T_2$, an upper packer $P_1$, the tubing anchor 10 and a lower packer $P_2$. When the two well packers are set, as illustrated in FIG. 2, the well may be employed to produce petroleum effluents from vertically spaced production zones $Z_1$ and $Z_2$. The tubing strings $T_1$ and $T_2$ separately communicate fluids produced from each of the zones to the well surface.

The primary function of the tubing anchor 10 in the typical application illustrated in FIGS. 1 and 2 is to carry the weight of a relatively long tubing string $T_a$ so that such weight need not be carried by the packer $P_1$.

After the well has been completed, it may be desired to remove the packer $P_1$ and tubing strings $T_1$ and $T_2$ from the well while leaving the tubing string $T_a$ in place. For this reason, as will be hereinafter more fully explained, the tubing anchor 10 includes means for permitting such removal while remaining firmly anchored in place supporting the tubing string $T_a$.

Also provided are means, selectively operable from the well surface, for retrieving the tubing anchor 10 and tubing string $T_a$ from the well either while the tubing string $T_1$ and packer $P_1$ are being removed or at some later time.

Figure 3:
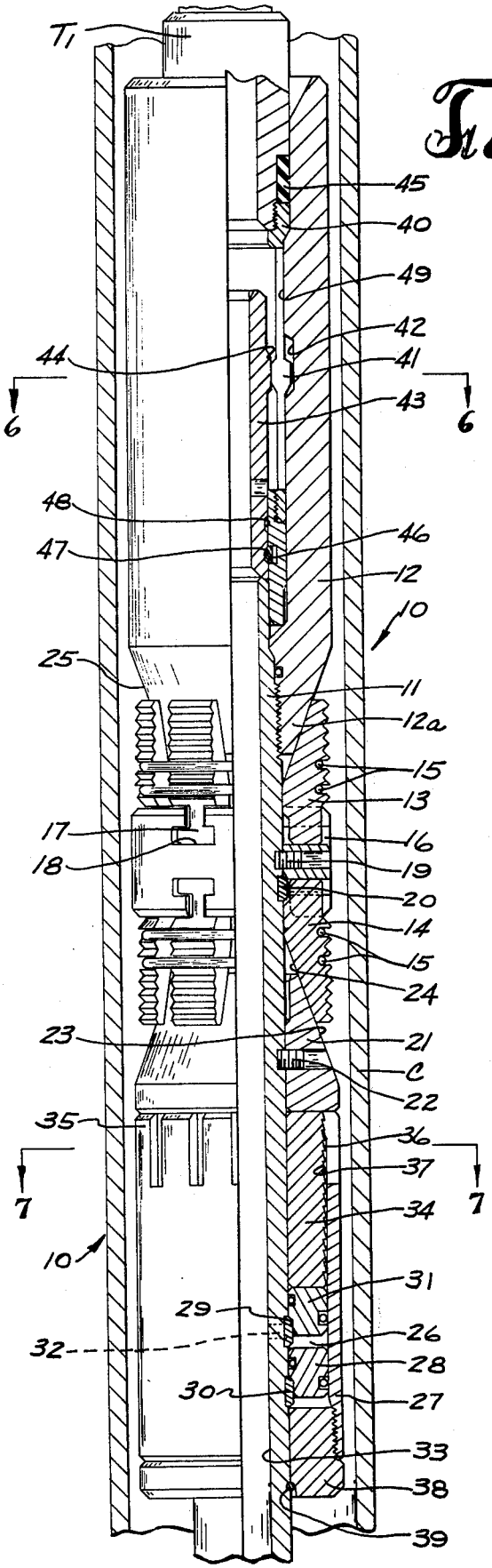
FIG. 3 is an enlarged scale elevation, partially in section, illustrating details in the construction of the present invention employed as a tubing anchor, in unset condition.

Referring to FIG. 3, the tubing assembly 10 has a central mandrel assembly which includes a main mandrel section 11 threadedly secured to an upper mandrel section 12. Upper, laterally movable gripping means or "slips" 13 and similar lower means 14 are carried about the main mandrel section. Circular resilient biasing means 15, such as metal springs or other resilient members, encircle both the upper and lower slips urging them radially inwardly toward the underlying main mandrel section. An annular cage 16 engages T-shaped foot pieces 17 at the base of the upper and lower slips to prevent the slips from moving longitudinally relative to each other. Corresponding T-shaped slots 18 in the cage trap the foot pieces 17 to prevent such relative longitudinal movement while simultaneously permitting the slips 13 and 14 to be moved radially outwardly as required for gripping the surrounding well casing C.

The annular cage 16 is temporarily secured to the main mandrel section 11 by a shear pin 19 to prevent premature setting and to ensure proper sequential movements of components during the setting procedure. A snap ring 20 placed in an annular groove in the main mandrel section 11 provides an inclined shoulder which, as will hereinafter be more fully explained, cooperates with an oppositely inclined shoulder on the lower gripping means 14 to ensure proper sequential movement of the gripping means during the setting procedure. A lower spreader cone 21 is secured by a shear pin 22 to the mandrel section 11. The pin 22 also prevents premature setting of the anchor as the assembly is being lowered into the well casing.

The spreader cone 21 includes a tapered external surface 23 which engages an oppositely tapered surface 24 formed on the inner side of the lower slips 14. Longitudinal closing movement between the lower spreader cone 21 and the slips 14 causes the slips to extend laterally outwardly into gripping engagement with the surrounding well conduit C. In a similar fashion, the lower end of the upper mandrel section 12 forms an upper spreader cone **12*a* which laterally extends the upper slips 13** as the two cones close toward each other longitudinally.

The tubing anchor 10 is set by advancing the lower spreader cone 21 toward the upper spreader cone 12. This movement is effected by applying pressurized hydraulic fluid to an expansion chamber 26. The chamber 26 is defined within the annular space included between the mandrel section 11 and an outer locking sleeve 27. The lower end of the chamber is formed by an annular ring 28 which is held in place on the mandrel by axially spaced snap rings 29 and 30. Suitable O-ring seals are carried by the ring 28 to provide a leakproof engagement with the tubular bodies contacting the ring. A similar ring 31 defines the upper end of the chamber 26 and is also equipped with annular seals which form a sliding, sealing engagement between the ring 31 and the two cylindrical surfaces contacting the ring. A radial port 22 extends through the tubing section 11 to permit fluid pressure contained within a central flow passage 33 in the mandrel to communicate with the chamber 26. Because of the high pressures involved, the snap ring 29 offers no effective impedance to the transfer of fluid pressure between the flow passage 33 and the expansion chamber 26.

The application of pressurized fluid to the chamber 26 causes the ring 31 to move upwardly through the annular space defined between the mandrel section 11 and the locking sleeve 27. This upward movement of the ring 31 is imparted to a locking ring 34 which in turn imparts the movement to the lower spreader cone 21.

Figure 7:
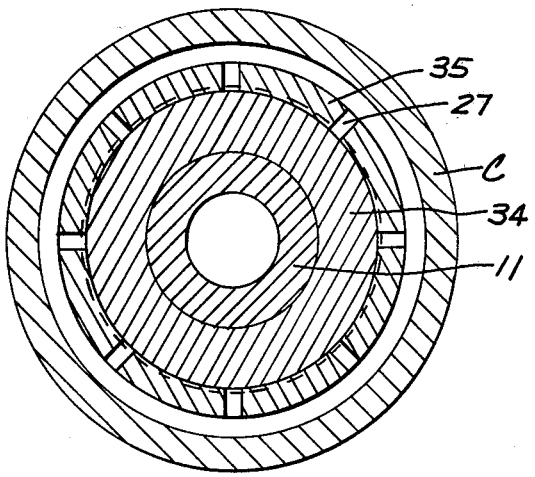
FIG. 7 is a horizontal cross-sectional view taken along the line 7—7 of FIG. 3.

A plurality of collet fingers 35 (see also FIG. 7) formed along the upper end of the locking sleeve 27 physically contact the external surface of the locking ring 34. The external surface of the ring 34 is provided with a series of axially spaced, circumferentially extending contours 36 which form downwardly facing shoulders separated from each other by inclined side surfaces. The internal surfaces of the collet fingers 35 are provided with similar, but oppositely facing, contours 37. The profile of these two contours are substantially in the shape of oppositely facing, saw-toothed configurations. The collet fingers 35 are biased resiliently inwardly against the external surface of the lock ring 34.

As will be appreciated, the contours 36 and 37 cooperate such that longitudinal movement of the slip ring 34 upwardly relative to the collet fingers 35 causes the collet fingers to be moved radially outwardly which permits the ring 34 and sleeve 27 to move relative to each other. The reverse longitudinal movement between these two lock components is prevented, however, because of the engagement the two facing end surfaces on the contours. As a result, the contours 36 and 37 permit the lock ring 34 and lock sleeve 27 to function as a ratchet permitting only relative movement between the two lock elements in a single longitudinal direction.

While the preferred form of the contours 36 and 37 is in the form of helically developed, thread-like shoulder configurations, other suitable configurations which permit a ratchet action may also be employed. Thus, by way of example rather then limitation, the contours may be formed by a series of axially spaced shoulders in the form of endless rings which extend circumferentially along the contour surfaces. Other suitable means, for example, comprised of a series of projections rather than thread-like developments or shoulders may also be employed.

Downwardly directed forces acting against the lock ring 34 are transferred through the ratchet mechanism to the sleeve 27. The sleeve 27 is secured by threaded connection to a lower annular end piece 38 which in turn is secured to the mandrel between the snap ring 30 and a shear ring 39. As will be hereinafter more fully explained, the ring 39 has sufficient structural strength to prevent displacement of the end piece 38 relative to the mandrel section 11 during the setting operation but is designed to shear and release the end piece when the anchor 10 is being retrieved.

Figure 6:
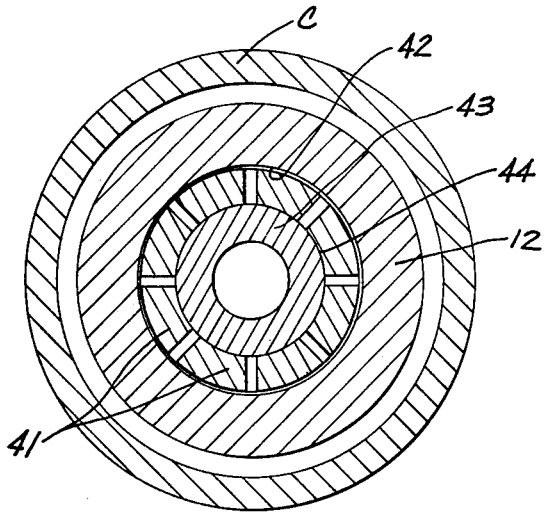
FIG. 6 is a horizontal cross-sectional view taken along the line 6—6 of FIG. 3.

The upper end of the tubing anchor 10 is equipped with release means which permit the tubing string $T_1$ to be released from the set anchor. To this end, the lower end of the tubing string$T_1$ is threadedly secured to a locking element 40 which includes a plurality of dogs 41 (see also FIG. 6) releasably disposed within an annular groove 42 formed in the upper end of the mandrel section 12. A lock sleeve 43 is equipped with an annular ridge 44 which holds the dogs 41 within the groove 42. Upward forces exerted on the tubing anchor 10 through the tubing string $T_1$ with the lock sleeve 43 in the illustrated position, draw the dogs 41 upwardly to the top of the groove 42. The ridge 44 prevents the dogs 41 from moving radially out of the groove to thus prevent separation of the tubing string and the anchor. A seal 45 carried by the tubing string $T_1$ engages a smooth cylindrical surface along the inner portion of the mandrel section 12 to maintain a fluid-tight seal between the tubing and anchor.

When it is desired to release the tubing $T_1$ from the set anchor, a suitable mechanism, wireline or otherwise operated, is lowered through the tubing string $T_1$ from the surface into engagement with the upper end of the lock sleeve 43 to hold the lock sleeve downwardly as the tubing string $T_1$ is raised relative to the set anchor. This prevents the locking sleeve 43 from moving upwardly with the tubing string $T_1$. The relative motion between the lock ring 43 and the locking element 40 causes a split snap ring 46 to expand radially out of a lower groove 47 in the sleeve 43. In the absence of a downward restraining force acting on the lock sleeve 43, the snap ring 46 causes the sleeve to move longitudinally with the locking element 40 so that the ridge 44 is constantly held against the dog 41 thus preventing the dog from slipping out of the groove 42. However, with the downward restraining force acting on the sleeve 43, the element 40 may be pulled upwardly causing the snap ring 46 to move out of the lower groove in the sleeve 43 and to snap into an upper sleeve groove 48. This shift in longitudinal relationship between the sleeve 43 and locking element 40 draws the ridge 44 below the dog 41 so that subsequent upward movement of the tubing string $T_1$ and the attached locking element 40 causes the dog 41 to move radially out of groove 42 onto an internal projection or reduced diameter mandrel section 49 thereby permitting tubing $T_1$, the attached locking element 40 and the ring 43 to be completely removed from the well. As will be appreciated, suitable inclined bearing surfaces are formed in the grooves 42, 47 and 48 and on the split ring 46 and the dogs 41 so that the desired camming motions are effected by relative longitudinal movement of the various components causing the desired radial movement of the split ring 46 and dogs 41.

TUBING ANCHOR OPERATION

In a typical well completion procedure, after the well bore has been drilled and suitably cased or lined with the well conduit C, the packer $P_2$ (FIGS. 1 and 2) is lowered into the well bore and anchored in position.

The equipment used to lower and anchor the packer $P_2$ is then removed from the well and an assembly comprised of the tubing string $T_1$, unset packer $P_1$, unset tubing anchor 10 and tubing string $T_a$ is lowered downwardly into the well conduit C. The lower end of the tubing string $T_a$ passes through and seals with a central opening (not illustrated) extending through the packer $P_2$. Suitable stop means are usually provided between the tubing anchor $T_a$ and the packer $P_2$ so that the packer $P_1$ and the tubing anchor 10 will be at the desired subsurface location when the stops engage. It may be noted that in a typical installation, the tubing string $T_2$ is usually not placed until after the packer $P_1$ has been suitably placed within the well conduit. After such placement, the tubing string $T_2$ may be lowered into the well and into engagement with the packer $P_1$ where it extends through the seals with an opening (not illustrated) provided through the packer.

Figure 4:
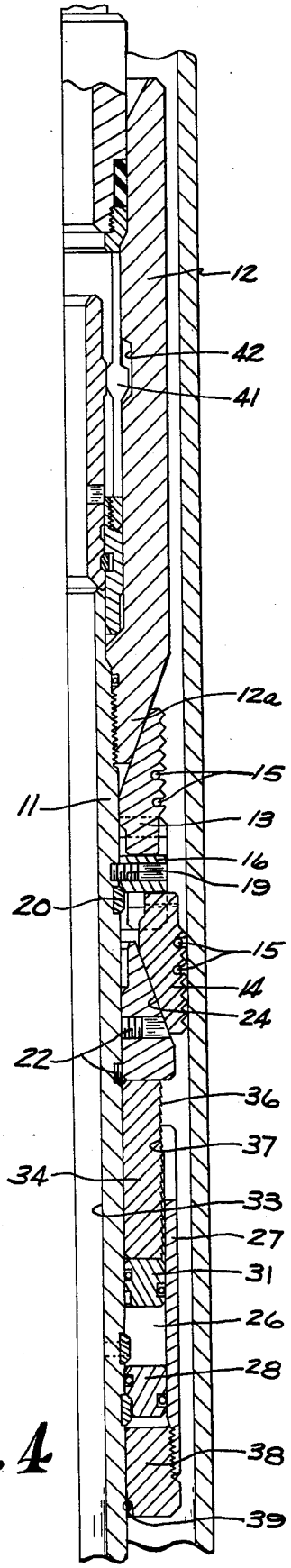
FIG. 4 is a vertical, quarter-sectional view illustrating the tubing anchor of FIG. 3 in partially anchored form.

With the components in the relative positions illustrated in FIG. 1, a plug, ball or other suitable sealing device (not illustrated) is pumped downwardly through the tubing string $T_1$ into sealing engagement with a seat (not illustrated) formed below the radial port 32 in the tubing anchor 10. When the desired seal is obtained, subsequent hydraulic pressure applied from the well surface through fluid contained within the tubing string $T_1$ acts through the mandrel passage 33, through the radial opening 32 and into the chamber 26. This hydraulic pressure induces axially directed forces against the rings 31 and 28. When sufficiently large upwardly directed forces are exerted through the ring 31 and locking ring 34 against the base of the spreader cone 21, the shear pin 22 severs as illustrated in FIG. 4, permitting the cone 21 to move upwardly along the mandrel section 11 and under the lower slip segments 14. The coengaged inclined surfaces between the cone and slips translate the longitudinal movement of the cone 21 to lateral outward movement of the slip segments 14. This outward movement overcomes the resilient biasing force exerted by the means 15 which tend to maintain the slip segments 14 in a radially retracted position. The shear pin 19 prevents the cage 16 from moving upwardly as the slip segments 14 are extended laterally during this setting procedure.

Figure 5:
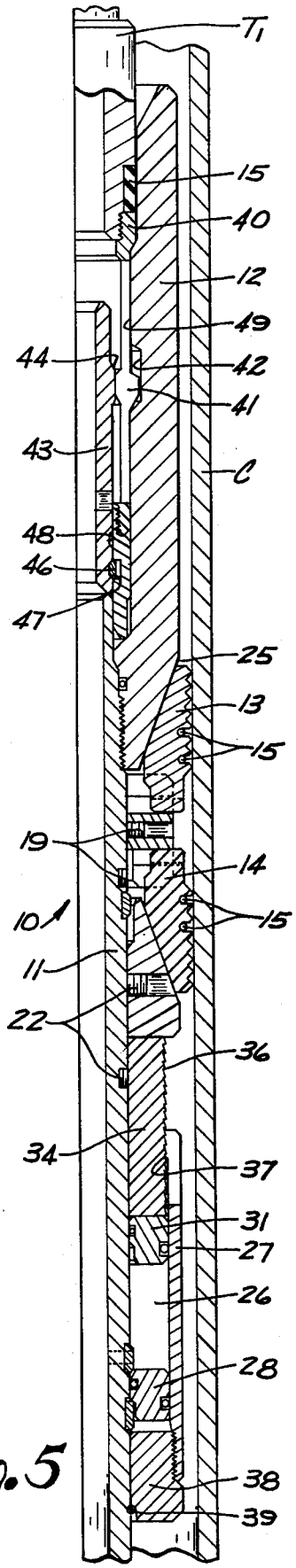
FIG. 5 is a view similar to FIG. 4 illustrating the tubing anchor fully anchored in position within a surrounding well conduit.

Once the lower slip segments 14 are in the position illustrated in FIG. 4, the cone 21 cannot move further upwardly so that the continued expansion of the chamber 26 induces a substantial downwardly directed force of the lower ring 28, lock sleeve 27 and annular end piece 38 which acts through the shear ring 39 to impart the same force to the mandrel section 11. Since the lower slip segments 14 are in anchored engagement with the surrounding well conduit C, the slip cage 16 and shear pin 19 are prevented from movement downwardly. As a result, the pressure induced downwardly directed forces on the mandrel section 11 cause the pin 19 to shear as illustrated in FIG. 5. This permits the mandrel to move downwardly relative to the slip segments. As this downward movement occurs, the hydraulic pressure in the chamber 26 continues to exert an upward force on the upper ring 31 and locking sleeve 34, holding the latter member in firm contact with the base of the cone 21.

Once the pin 19 shears, and the mandrel section 11 moves downwardly, the attached external spreading surface 25 pushes the upper slip segments 13 radially outwardly into gripping engagement with the surrounding well conduit C. The anchor is then fully set as illustrated in FIG. 5.

When the pressure of the hydraulic fluid acting through the mandrel 11 to the expansion chamber 26 is reduced, the set slips act against their respective spreader cones to exert a return force on the locking ring 34 and locking sleeve 27 tending to return the two components from the position illustrated in FIG. 5 to that illustrated in FIG. 3. This return movement is prevented by engagement of the contoured surfaces 36 and 37 so that the tubing anchor 10 remains firmly anchored after the setting pressure is completely relieved.

With reference to FIG. 5, if it becomes necessary or desirable to remove the tubing string $T_1$ from the set tubing anchor 10, a suitable retrieving means is employed for holding the lock sleeve 43 in engagement with the upper end of the mandrel section 11 while an upward pull is exerted on the tubing string $T_1$. This upward force causes inclined surfaces on the snap ring 46 and the lock sleeve groove 47 to urge the snap ring radially outwardly out of the groove 47 permitting the locking element 40 to move upwardly relative to the sleeve. When the snap ring 46 is raised into registration with the annular groove 48, it snaps into the groove causing the sleeve 43 to move with element 40 once the sleeve is freed from the retrieving means. When this relative shift between the lock sleeve 43 and the locking element 40 is completed, the ridge 44 no longer prevents the dogs 41 from moving radially inwardly out of the groove 42 as the tubing string $T_1$ is elevated. As a result, the entire lower end of the tubing string $T_1$ may be lifted free of the mandrel section 12.

When it is desired to reengage the tubing string $T_1$ to the set anchor 10, the tubing string $T_1$, locking element 40 and lock sleeve 43 are lowered back into the upper mandrel section 12. During this reengagement procedure, the lock ring 47 is positioned in the groove 48 so that the dogs 41 may be biased radially inwardly as they are lowered to clear the projection 49. Once the dogs 41 are positioned in the groove 42, continued lowering of the tubing string $T_1$ brings the sleeve 43 against the top of mandrel section 11 which shifts the sleeve 43 upwardly into the position illustrated in FIG. 5 so that the locking element 40 is thereafter prevented from separating from the tubing anchor when the tubing string $T_1$ is subsequently raised.

If it is desired to retrieve the tubing anchor from the well, the tubing string $T_1$ is pulled upwardly until the shear ring 39 severs. When this occurs, the upper cone face 25 may be moved upwardly relatively to the slip member 13 permitting the resilient biasing means 15 to return the slips to their retracted position. Continued upward movement of the mandrel 11 draws the snap ring 20 into engagement with the cage 16 so that the upward mandrel movement is imparted to the lower slip segments 14. By this means, the lower slip segments may be pulled off of the cone 21 so that the resilient means 15 may return the slips to their radially retracted position. With both sets of slip segments retracted, the tubing anchor 10 may be completely withdrawn from the well conduit C.

WELL PACKER

Figure 8:
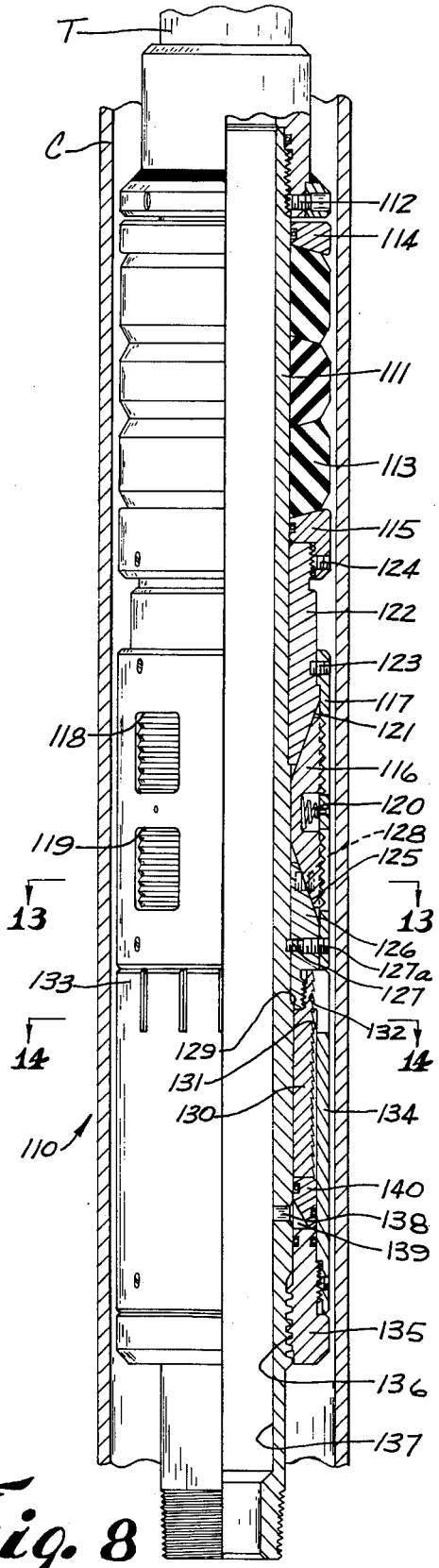
FIG. 8 is an elevation, partially in section, illustrating a modified form of the invention, employed as a well packer, in unset condition.

FIG. 8 illustrates the anchoring assembly of the present invention employed to provide a well packer indicated generally at 110. A tubing string T suspends the well packer in a well conduit C. The packer 110 includes a mandrel 111 threadedly engaged to the base of the tubing string T. Set screws 112 prevent undesired separation of the threaded engagement. Annular seal rings 113 are mounted about the mandrel 111 between upper and lower end rings 114 and 115 respectively. The seal rings 113 are constructed of a resilient material such as rubber or other suitable material as is well known in the packer art.

A set of slip elements 116 confined within a slip cage 117 is disposed circumferentially about the mandrel 111. Upper and lower windows 118 and 119, respectively, permit the gripping teeth of the slip elements 116 to move outwardly into gripping engagement with the surrounding well conduit C. Spiral spring elements 120 positioned between the cage and the slip elements bias the slip elements to a radially retracted position out of gripping engagement with the well conduit.

Tapered interior surfaces along the upper portion of each slip element engage an oppositely inclined surface 121 formed on an upper spreading member 122. A mandrel shoulder 111*a* limits downward movement of the member 122 relative to the mandrel for a purpose to be described. A shear pin 123 prevents upward relative movement of the cage 117 over the spreading member 122 and engaged shoulders between the cage and spreading member prevent downward relative movement between the two. The spreading member is threadedly engaged to the lower end ring 115 and held in place by a suitable set screw 124.

Figure 13:
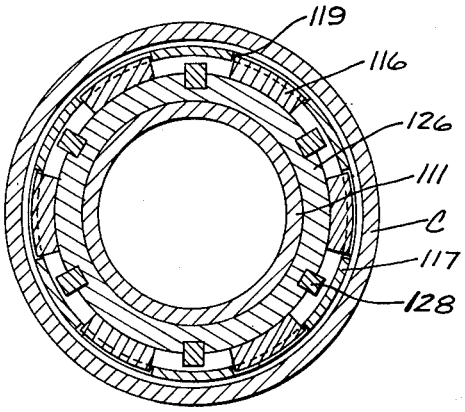
FIG. 13 is a horizontal cross-sectional view taken along the line 13—13 of FIG. 8.
Figure 14:
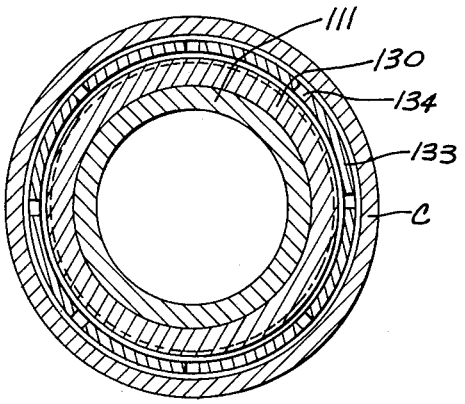
FIG. 14 is a horizontal cross-sectional view taken along the line 14—14 of FIG. 8.

A lower spreading surface 125 engages the lower inclined interior surfaces of the slip elements 116. The surface 125 is formed on a lower spreading member 126. The member 126 is secured to the mandrel 111 by a shear pin 127 and the slip cage 117 is centered about the mandrel by centering pins 128 (see FIG. 13) which extend from the member 126 and engage the inner surface of the cage. A shear pin 127*a* secures the member 126 to the slip cage 117.

A mandrel shoulder 129 prevents the lower spreading member 126 from moving downwardly relative to the mandrel from the position illustrated in FIG. 8. A locking ring 130 is threadedly secured to the lower end of the member 126. A contour 131 similar to the previously described contour 36 in the tubing anchor 10 is formed on the external radial surface of the locking ring 130. This contour 131 engages a similar but oppositely formed contour 132 provided along the internal radial face of collet fingers 133. The contour 132 and the collet fingers 133 are similar, respectively, to the collet fingers 35 and contour 37 described with reference to the tubing anchor 10.

The collet fingers 133 are formed at the upper end of a locking sleeve 134 which in turn is secured at its base to a retrieving element 135. Set screws lock the sleeve 134 to the retrieving element 135 to prevent undesired separation of the threaded engagement between the two members. The internal surface of the retrieving element 135 and the external surface of the mandrel 111 are provided with coengaging retrieving threads 136.

Setting of the packer 110 is accomplished by the application of pressurized fluid through a mandrel passage 137. The pressurized fluid is communicated through a radial port 138 to an expansion chamber 139. The chamber 139 is defined between the mandrel 111, the locking sleeve 134, the retrieving element 135 and a movable ring 140. Annular resilient O-ring seals on the retrieving element 135 and ring 140 prevent pressure loss from the chamber 139.

SETTING THE PACKER

Figure 9:
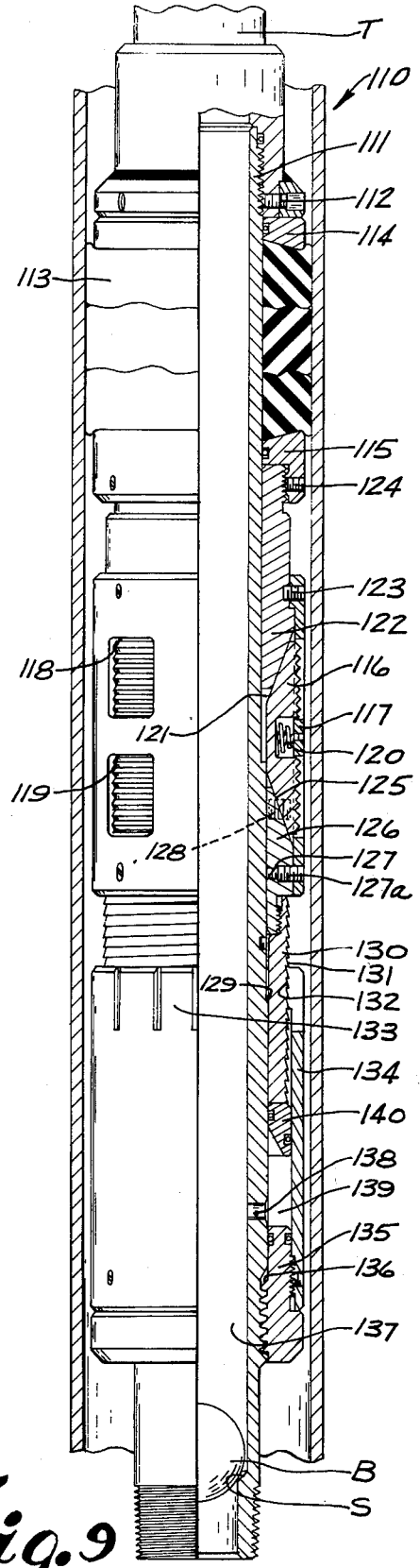
FIG. 9 is a view similar to FIG. 8 illustrating the well packer in partially set condition.

The well packer 110 is suspended from the tubing string T and lowered to the desired subsurface position within the well conduit C. A ball B is pumped downwardly through the tubing string T into sealing engagement with a seat S. Once the ball B has been seated, hydraulic pressure may be built up within the mandrel passage 137. This pressure acts through the port 138 in the chamber 139 to cause the ring 140 to move longitudinally upwardly along the mandrel 111. The upward force acts through the locking ring 130 to the lower spreading member 126. When sufficient forces are generated, the shear pin 127 is severed permitting the member 126 to move upwardly. This upward movement is transferred from the member 126 to the cage 117 through the shear pin 127*a*. The shear pin 123 transfers the upward cage movement to the upper spreading member 122 which in turn moves the lower end ring 115 upwardly along the mandrel 111. Movement of the ring 115 toward the ring 114 causes the seal rings 113 to be axially foreshortened and thus radially extended into sealing engagement with the surrounding well conduit C as illustrated in FIG. 9.

Figure 10:
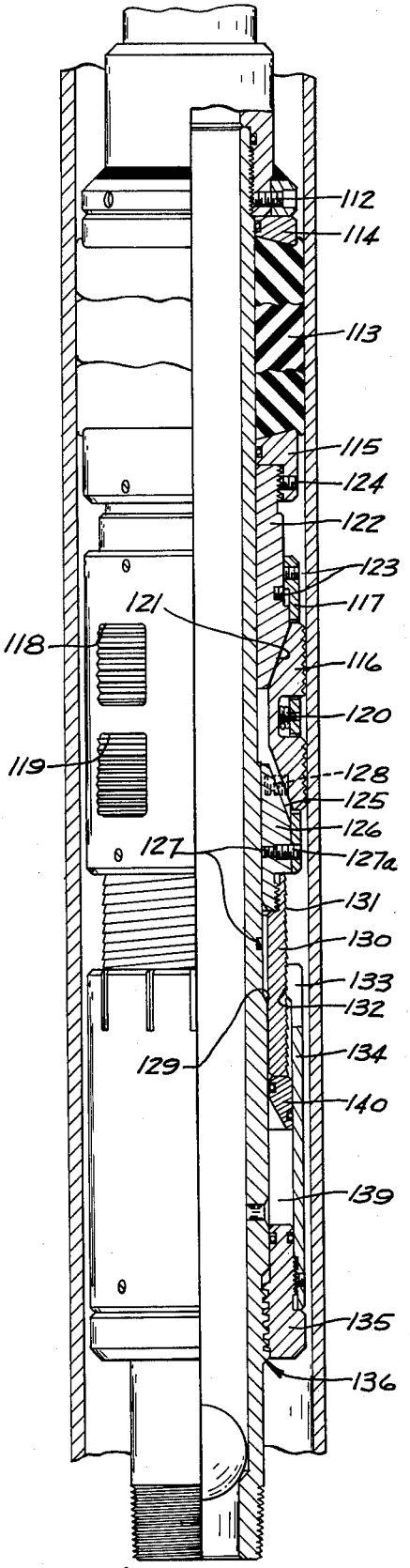
FIG. 10 is a view similar to FIG. 8 illustrating the well packer just before it is fully set.
Figure 11:
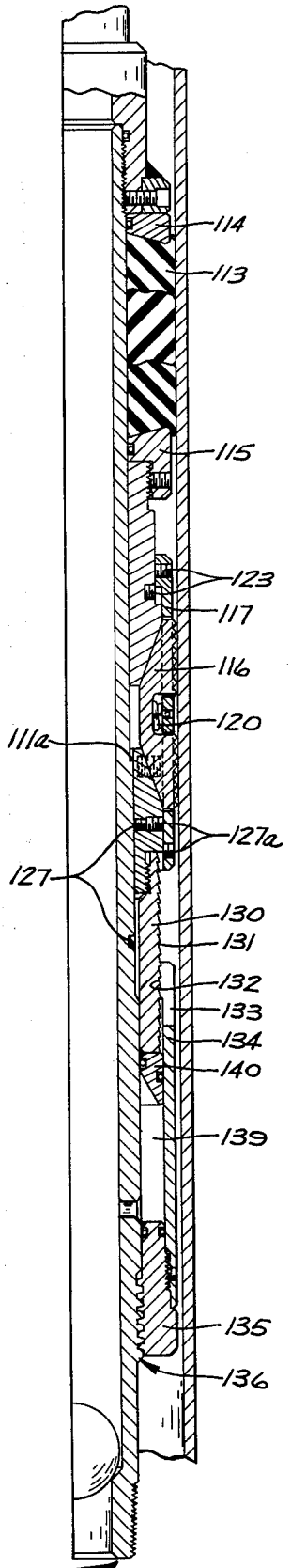
FIG. 11 is a vertical quarter-sectional view illustrating the well packer in fully set condition.

When the seal rings 113 have been sufficiently compressed, they strongly resist further upward movement of the lower ring 115. Continued upward movement of the ring 140, locking ring 130, spreading member 126 and cage 117 causes the shear pin 123 to sever. This is turn permits the slip elements 116 to be moved longitudinally relative to the spreading surface 121 which in turn causes the slip elements 116 to extend radially outwardly against the biasing force exerted by the springs 120 as illustrated in FIG. 10. Still further movement severs the pin 127*a* permitting the lower spreading member 126 to move upwardly under the inclined interior surface of the slip element 116 as illustrated in FIG. 11. The closing longitudinal movement of the two inclined spreading surfaces 121 and 126 thus forces the slip elements 116 radially outwardly into firm anchoring engagement with the surrounding well conduit C so that the well packer is fully set as illustrated in FIG. 11.

Once the packer is set, the collet fingers 133 lock to the locking ring 130 to prevent the ring 130 from returning downwardly and releasing the packer from its set condition. The opposite longitudinal movement of the two components is permitted as explained previously with reference to the similar features included in the tubing anchor 10.

Figure 12:
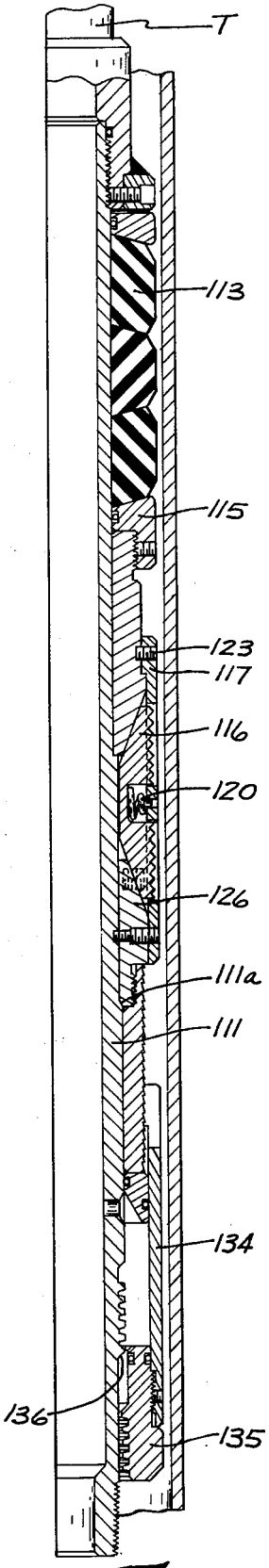
FIG. 12 is a vertical quarter-sectional view illustrating the well packer after it is released from set condition.

If it becomes desirable to release the packer, the tubing string T is rotated (preferably in a clockwise direction as viewed in FIG. 13 where right-hand threads are employed to connect tubing sections) causing the interengaged threads 136 to disengage as illustrated in FIG. 12. Once the threads 136 are disengaged, the mandrel 111 is freed for upward movement relative to the anchored slip segments 116. Such upward movement initially permits the seal rings 113 to return to their normally retracted condition. Subsequent lifting draws the mandrel shoulder 111*a* into contact with the base of the upper spreading member 122 which permits the spreading member to be withdrawn from under the slip element 116. Continued lifting causes the shoulder on the member 122 to engage the shoulder on the slip cage 117 so that the slip cage is elevated along with the mandrel. The base of the slip cage windows 119 engage the lower end of the slip segments 116 causing the slips to move upwardly and out of wedging engagement with the lower spreading member 126. When the slips are thus freed, the springs 120 return the slip members 116 to their radially retracted position as illustrated in FIG. 12 to permit retrieval of the well packer.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. An anchoring assembly for use in a well conduit comprising:

a. a longitudinally extending mandrel assembly;

b. laterally movable gripping means carried by said mandrel assembly for lateral movement into anchoring engagement with said well conduit;

c. setting means carried by said mandrel assembly and movable relative to said gripping means for moving said gripping means into anchoring engagement with said well conduit;

d. locking means for retaining said gripping means in anchoring engagement with said well conduit, said locking means including:

i. a first lock member movable longitudinally relative to said mandrel assembly;

ii. a second lock member releasably fixed against longitudinal movement relative to said mandrel assembly; and iii. ratchet means connecting said first and second lock members together for permitting relative longitudinal movement between said first and second lock members in only one direction;

iv. one of said lock members being radially resiliently biased toward the other of said lock members.

2. An anchoring assembly as defined in claim 1 wherein:

a. at least one of said lock members includes a plurality of longitudinally extending, circumferentially spaced radially movable locking means;

b. said first lock member includes substantially tubular body carried about said mandrel assembly;

c. said ratchet means includes cooperating, engaged contours on said first and second lock members; and d. at least a portion of said contours are formed on said radially movable locking means.

3. An anchoring assembly as defined in claim 2 wherein:

a. said second lock member includes a substantially tubular body fixed about said mandrel assembly;

b. said first lock member is disposed between said mandrel assembly and said second lock member; and c. said radially movable locking means include finger means formed on said second lock member.

4. An anchoring assembly as defined in claim 1 wherein:

a. said mandrel assembly comprises a substantially tubular body;

b. said setting means includes at least one spreading means longitudinally movable along said mandrel assembly moving said gripping means into anchoring engagement with said well conduit; and c. said first lock member is operatively connected to said spreading means by non-wedging means for preventing longitudinal movement of said spreading means in at least one direction relative to said first lock member.

5. An anchoring assembly as defined in claim 2 wherein:

a. said mandrel assembly comprises a substantially tubular body;

b. said setting means includes at least one spreading means longitudinally movable along said mandrel assembly for moving said gripping means into anchoring engagement with said well conduit; and c. said first lock member is operatively connected to said spreading means by non-wedging means for preventing longitudinal movement of said spreading means in at least one direction relative to said first lock member.

6. An anchoring assembly as defined in claim 3 wherein:

a. said first lock member includes an outer cylindrical surface and said contours include a plurality of axially spaced shoulder means with inclined surface means extending between adjacent shoulder means on said cylindrical surface;

b. said finger means includes circumferentially spaced, partial cylindrical surfaces and said finger means contours include a plurality of axially spaced shoulder means with inclined surface means extending between adjacent shoulder means, said shoulder means and said inclined surfaces on said finger means and said first lock member being oppositely disposed and formed whereby when in contact, said shoulders prevent relative movement of said first and second lock members in one longitudinal direction.

7. An anchoring assembly as defined in claim 6 wherein:

a. said mandrel assembly comprises a substantially tubular body;

b. said setting means includes at least one spreading means longitudinally movable along said mandrel assembly for moving said dripping means into anchoring engagement with said well conduit; and c. said first lock member is operatively connected to said spreading means by non-wedging means for preventing longitudinal movement of said spreading means in at least one direction relative to said first lock member.

8. An anchoring assembly as defined in claim 4 further including resilient seal means carried by said mandrel assembly and operable by said setting means for lateral movement into sealing engagement with said well conduit.

9. An anchoring assembly as defined in claim 2 further including resilient seal means carried by said mandrel assembly and operable by said setting means for lateral movement into sealing engagement with said well conduit.

10. An anchoring assembly as defined in claim 5 further including resilient seal means carried by said mandrel assembly and operable by said setting means for lateral movement into sealing engagement with said well conduit.

11. An anchoring assembly as defined in claim 1 further including means for releasing from, and reattaching to, said mandrel assembly when said anchoring assembly is set in said well conduit.

12. An anchoring assembly as defined in claim 1 further including retrieving means for releasing said gripping means from anchoring engagement with said well conduit.

13. An anchoring assembly as defined in claim 2 wherein:

a. said gripping means includes a plurality of slip elements circumferentially spaced around said mandrel assembly;

b. said slip elements are mounted for radial movement within a slip cage carried on said mandrel assembly; and c. said slip elements are biased radially inwardly toward said mandrel assembly by biasing means.

14. An anchoring assembly as defined in claim 13 wherein said setting means includes dual, opposed spreading elements carried on said mandrel assembly and movable longitudinally toward each other for moving said slip means radially outwardly into anchoring engagement with said well conduit.

15. An anchoring assembly as defined in claim 14 wherein said setting means includes hydraulically operable means, responsive to fluid pressure in said mandrel assembly, for moving said spreading elements and setting said anchoring assembly.

16. An anchoring assembly as defined in claim 15 further including resilient seal means carried by said mandrel assembly and operable by said setting means for lateral movement into sealing engagement with said well conduit.

17. An anchoring assembly as defined in claim 16 further including means for releasing from, and reattaching to, said mandrel assembly when said anchoring assembly is set in said well conduit.

18. An anchoring assembly as defined in claim 15 further including frangible pin means, frangible sequentially in response to forces exerted through said setting means for sequentially radially extending said seal means and said anchoring means during the setting of said anchoring assembly.

19. An anchoring assembly as defined in claim 17 further including frangible pin means, frangible sequentially in response to forces exerted through said setting means for sequentially radially extending said seal means and said anchoring means during the setting of said anchoring assembly.

20. An anchoring assembly as defined in claim 16 wherein said second lock member is releaseable from said mandrel assembly by rotation of said mandrel assembly for releasing said gripping means from anchored engagement with said well conduit.

21. An anchoring assembly as defined in claim 16 wherein said second lock member is releaseable from said mandrel assembly by longitudinal, non-rotational movement of said mandrel assembly for releasing said gripping means from anchored engagement with said well conduit.

22. A well assembly for use in a well conduit comprising:

a. a mandrel assembly;

b. slip means carried about said mandrel assembly for selectively moving said slips from a radially retracted position to a radially extended position engaging said well conduit to thereby anchor said well assembly in place within said well conduit;

c. setting means carried by said mandrel assembly and operable for moving said slip means into said radially extended position;

d. locking means carried by said mandrel assembly for retaining said slip means in said radially extended position, said locking means including first and second telescoping tubular locking bodies nonwedgingly urged together to permit relative longitudinal movement between said first and second locking bodies in a direction permitting said radial slip extension and prevent the reverse longitudinal movement between such locking bodies to retain said slip means in said radially extended position.

23. A well assembly as defined in claim 22 wherein:

a. said mandrel assembly is tubular and includes a main mandrel body;

b. said first and second locking bodies are concentrically disposed about said main mandrel body;

c. said first locking body is free for limited longitudinal movement relative to said main mandrel body; and d. connecting means selectively connect and prevent relative longitudinal movement between said main mandrel body and said second locking body.

24. A well assembly as defined in claim 23 wherein said connecting means is separable upon predetermined movement of said mandrel assembly for releasing said second locking body for longitudinal movement relative to said main mandrel body to permit said slip means to be returned to said radially retracted position.

25. A well assembly as defined in claim 24 wherein said first and second locking bodies include engageable contours which permit relative longitudinal movement between said locking bodies in only one direction.

26. A well assembly as defined in claim 25 wherein at least a portion of said contours are formed on collet fingers resiliently mounted on one of said first or second locking bodies.

27. A well assembly as defined in claim 25 wherein said setting means includes dual opposed spreading means movable toward each other to extend said slip means radially outwardly.

28. A well assembly as defined in claim 27 wherein said setting means includes fluid pressure responsive means for moving said spreading means toward each other when pressurized fluid is applied to said mandrel assembly.

29. A well assembly as defined in claim 22 further including resilient seal means carried by said mandrel assembly and operable by said setting means for lateral movement into sealing engagement with said well conduit.

30. A well assembly as defined in claim 23 further including resilient seal means carried by said mandrel assembly and operable by said setting means for lateral movement into sealing engagement with said well conduit.

31. A well assembly as defined in claim 26 further including resilient seal means carried by said mandrel assembly and operable by said setting means for lateral movement into sealing engagement with said well conduit.

32. A well assembly as defined in claim 22 further including releasing means for releasably holding a running tool employed to position and set said well assembly within said well conduit, said releasing means including means operable from the well surface for releasing said running tool from said well assembly when said well assembly is anchored in said well conduit.

33. A well assembly as defined in claim 23 further including releasing means for releasably holding a running tool employed to position and set said well assembly within said well conduit, said releasing means including means operable from the well surface for releasing said running tool from said well assembly when said well assembly is anchored in said well conduit.

34. A well assembly as defined in claim 28 further including releasing means for releasably holding a running tool employed to position and set said well assembly within said well conduit, said releasing means including means operable from the well surface for releasing said running tool from said well assembly when said well assembly is anchored in said well conduit.

* * * * *

UNITED STATES PATENT AND TRADEMARK OFFICE

CERTIFICATE OF CORRECTION

PATENT NO. : 4,059,150

DATED : November 22, 1977

INVENTOR(S) : Phillip H. Manderscheid

It is certified that error appears in the above-identified patent and that said Letters Patent are hereby corrected as shown below:

In Column 5, line 49, insert the word --between--after "engagement".

In Column 7, line 17, delete the word "the" and insert therefor --and--.

In Column 12, line 41, delete the word "dripping" and insert therefor --gripping--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*